US011011820B2

(12) United States Patent
Johansson et al.

(10) Patent No.: US 11,011,820 B2
(45) Date of Patent: May 18, 2021

(54) ANTENNA SYSTEM PROVIDING COVERAGE FOR MULTIPLE-INPUT MULTIPLE-OUTPUT, MIMO, COMMUNICATION, A METHOD AND SYSTEM

(71) Applicant: Telefonaktiebolaget LM Ericsson (publ), Stockholm (SE)

(72) Inventors: Martin Johansson, Mölndal (SE); Henrik Asplund, Stockholm (SE); Mikael Coldrey, Landvetter (SE); Andreas Nilsson, Gothenburg (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 742 days.

(21) Appl. No.: 15/112,057

(22) PCT Filed: Jan. 20, 2014

(86) PCT No.: PCT/EP2014/051062

§ 371 (c)(1),
(2) Date: Jul. 15, 2016

(87) PCT Pub. No.: WO2015/106831

PCT Pub. Date: Jul. 23, 2015

(65) Prior Publication Data

US 2016/0329622 A1 Nov. 10, 2016

(51) Int. Cl.
*H01Q 1/00* (2006.01)
*H01Q 13/20* (2006.01)
(Continued)

(52) U.S. Cl.
CPC ..... *H01Q 1/007* (2013.01); *H01Q 1/3225* (2013.01); *H01Q 13/203* (2013.01); *H01Q 21/30* (2013.01)

(58) Field of Classification Search
CPC .... H01Q 1/007; H01Q 1/3225; H01Q 13/203; H01Q 21/30; H01Q 3/2688; H01Q 1/00
See application file for complete search history.

(56) References Cited

U.S. PATENT DOCUMENTS 3,422,438 A * 1/1969 Marston ..... H01Q 3/38 333/1.1
3,522,606 A * 8/1970 Michelson ..... G01S 13/422 342/371

(Continued)

FOREIGN PATENT DOCUMENTS

CN 202282461 U 6/2012
EP 0322109 A2 6/1989
JP 2007010639 A * 1/2007 ..... G01S 11/00

OTHER PUBLICATIONS

Homeland Security, Office of Grants and Training Directorate of Preparedness, "Interoperable Communications on Tunnels" Technical Information Working Group Technical Note 2006-1, Apr. 14, 2006 (Year: 2006).*

(Continued)

*Primary Examiner* — Dimary S Lopez Cruz
*Assistant Examiner* — Bamidele A Jegede
(74) *Attorney, Agent, or Firm* — Rothwell, Figg, Ernst & Manbeck, P.C.

(57) ABSTRACT

The disclosure relates to an antenna system 1 for providing coverage for multiple-input multiple-output, MIMO, communication in mixed type of spaces. The antenna system 1 comprises a leaky cable 2 arranged to provide coverage in a first type of space, and a distributed antenna system 3 comprising one or more antennas $\mathbf{3}_1$, $\mathbf{3}_2$, $\mathbf{3}_3$, $\mathbf{3}_4$ and ranged to provide coverage in a second type of space, wherein each of the one or more antennas $\mathbf{3}_1$, $\mathbf{3}_2$, $\mathbf{3}_3$, $\mathbf{3}_4$ of the distributed antenna system 3 is connected to the leaky cable 2 through a circulator $\mathbf{4}_1$, $\mathbf{4}_2$, $\mathbf{4}_3$, and wherein the MIMO communica- (Continued)

tion is enabled by both ends of the leaky cable 2 being adapted for connection to a respective antenna port 8, 9 of a network node 5 configured for 10 MIMO communication. The disclosure also relates to a related method and system.

20 Claims, 3 Drawing Sheets

(51) Int. Cl.
*H01Q 1/32* (2006.01)
*H01Q 21/30* (2006.01)

(56) References Cited

U.S. PATENT DOCUMENTS 4,559,489 A * 12/1985 Vacanti ..... H01P 5/12 333/1.1
4,661,993 A * 4/1987 Leland ..... H04B 7/084 333/1.1
4,916,460 A * 4/1990 Powell ..... H01Q 3/2676 343/853
4,972,505 A * 11/1990 Isberg ..... H01Q 13/203 455/3.01
5,018,165 A * 5/1991 Sohner ..... H04B 1/69 375/133
5,039,995 A * 8/1991 Hulbert ..... H01Q 21/08 343/853
5,230,080 A * 7/1993 Fabre ..... H04B 5/0018 455/15
5,953,659 A * 9/1999 Kotzin ..... H04B 7/0894 455/277.1
6,137,442 A * 10/2000 Roman ..... H01Q 3/2682 342/375
6,320,539 B1 * 11/2001 Matthews ..... H01Q 3/2676 342/375
6,396,600 B1 * 5/2002 Davies ..... H01Q 13/203 398/9
6,424,259 B1 7/2002 Gagnon
6,650,300 B2 * 11/2003 Skalina ..... H01Q 1/12 343/770
6,686,885 B1 * 2/2004 Barkdoll ..... H01P 1/184 342/372
2002/0084949 A1 * 7/2002 Skalina ..... H01Q 13/203 343/891
2007/0004363 A1 * 1/2007 Kusaka ..... H01Q 1/007 455/269
2007/0010279 A1 * 1/2007 Matsushita ..... H01Q 13/203 455/523
2007/0063914 A1 * 3/2007 Becker ..... A62C 35/60 343/840
2008/0051043 A1 * 2/2008 Greene ..... H04B 1/04 455/127.1
2008/0070502 A1 * 3/2008 George ..... H04B 10/25759 455/41.2
2009/0153147 A1 * 6/2009 Aizawa ..... G08B 13/2497 324/639
2009/0303149 A1 * 12/2009 Muller ..... H01Q 13/203 343/791
2010/0149068 A1 * 6/2010 Petersson ..... H01Q 1/246 343/893
2011/0199920 A1 * 8/2011 Takei ..... H01Q 7/00 370/252
2012/0219042 A1 8/2012 Onggosanusi et al.
2013/0069834 A1 * 3/2013 Duerksen ..... H01Q 1/32 343/711
2013/0127679 A1 * 5/2013 Harris ..... H01Q 13/12 343/756
2013/0162500 A1 * 6/2013 Coldrey ..... H04B 5/0018 343/904
2014/0118203 A1 * 5/2014 Sanford ..... H01Q 13/203 343/725
2018/0076515 A1 * 3/2018 Perlman ..... H04B 1/40

OTHER PUBLICATIONS

Molkdar, D., "Techniques to Provide Coverage and Capacity in GSM Picocellular Environments", Vehicular Technology Conference, 2000, IEEE VTS Fall VTC 2000, 52nd Sep. 24-28, 2000, Piscataway, NJ, USA, IEEE, vol. 6, Sep. 24, 2000, pp. 3008-3014, XP010525128.
Greenstein, L.J., "Microcells in Personal Communications Systems", IEEE Communications Magazine, IEEE Service Center, Piscataway, US, vol. 30, No. 12, Dec. 1, 1992, pp. 78-88, XP000330092.
International Search Report and Written Opinion dated Oct. 21, 2014 in International Application No. PCT/EP2014/051062, 9 pages (copy previously filed).
Russian Office Action with Search Report issued in Application No. 2016133860/28(052628) dated Jun. 8, 2017, 14 pages.
First Chinese Office Action with English Summary and Translation, issued in Chinese Patent Application No. 201480073608.5, dated Feb. 26, 2018, 10 pages.
Chinese Office Action issued in Application No. 201480073608.5 dated Sep. 5, 2018, 9 pages.
Third Chinese Office Action with English Translation, issued in Chinese Patent Application No. 201480073608.5, dated Feb. 3, 2019, 8 pages.

* cited by examiner

ANTENNA SYSTEM PROVIDING COVERAGE FOR MULTIPLE-INPUT MULTIPLE-OUTPUT, MIMO, COMMUNICATION, A METHOD AND SYSTEM

TECHNICAL FIELD

The technology disclosed herein relates generally to the field of radio communication, and in particular to antenna systems for providing coverage for multiple-input multiple-output, MIMO, communication.

BACKGROUND

A large part of the traffic load in future wireless communication systems is expected to originate from indoor users, for example from users in office buildings, cafés, shopping malls etc. Providing the indoor users with high bit-rate and spectrally efficient communication from outdoor base stations is challenging due to the penetration loss that is experienced by signals propagating through building walls. One known solution for enhancing the indoor coverage is to use outdoor-to-indoor repeaters. An outdoor-to-indoor repeater has a pick-up antenna on the outside of the building connected via a double-directional power amplifier to a donor antenna on the inside of the building. Another known solution is to deploy pure indoor systems for example by deploying an indoor radio base station (RBS) and connect it to a distributed antenna system (DAS) where the antennas are also located indoor and close to the users.

Leaky (coaxial) cables can be used both for transmitting and for receiving electromagnetic waves, i.e. allows for two-way communication. Typical use cases for leaky cables are indoor deployments and along railway tunnels etc. Put simply, a leaky cable is a coaxial cable with slots or gaps along its entire length which enable the cable to "leak" electromagnetic waves. The leaky cable can be used both to transmit and receive electromagnetic waves, i.e. it allows two-way communication.

Multiple-input Multiple-output (MIMO) technology is developed and used in wireless communication systems, and has been incorporated as an important feature in Long Term Evolution (LTE) standards. MIMO provides higher data rates by using several antennas to transmit and receive signals. By combining signals properly in a receiver an improved signal quality and/or data rate is provided for users within the communication system.

SUMMARY

A MIMO wireless system may be used in various types of environments to provide coverage and capacity. In indoor scenarios the traffic demand may be heterogeneous e.g. due to building floor plans and user behavior. This puts different requirements on radio link budget at different positions in the building.

Leaky cables exhibit radiation properties different from the properties of traditional DAS and provide almost constant local signal strength along the cable, with only a slow decay of the field strength with distance. This generates uniform coverage for a given distance from a leaky cable installed along a straight line, making leaky cables particularly well suited for use in corridors, tunnels, and other cylinder-like spaces, i.e. spaces with one dimension being significantly larger than the other two, cross-sectional, dimensions. This is illustrated in FIG. 1*a*, wherein the dashed line illustrates the leaky cable. FIG. 1*b* illustrates a space wherein the cross-sectional dimensions vary and the leaky cable cannot be installed along a straight line as in the case of e.g. a tunnel (as illustrated in FIG. 1*a*). That is, the routing of the leaky cable (the dashed line again illustrating the leaky cable) deviates from a straight line and has to be adjusted to provide coverage in all areas. This makes the cable installation more difficult and costly, both from a labor and material point-of-view. Since leaky cables are relatively expensive and complicated to install, due to their weight and stiff profile, this poses a major problem.

A distributed antenna system (DAS) uses a discrete set of antennas to provide coverage. Since each antenna acts as a point source in terms of the path loss behavior (ignoring any potential extra gain from the radiation pattern), the antennas need to be distributed over the coverage area. In corridors, tunnels, and other cylinder-like spaces, i.e. spaces with one dimension being significantly larger than the other two, cross-sectional, dimensions, multiple DAS-antennas need to be installed to ensure coverage, even in the case of directive antennas with main beam direction along the larger dimension. This is illustrated in FIG. 1*c* (a dot illustrating an antenna). With such discrete placement of antennas, the coverage will vary between the antennas and many antennas may be required to achieve a desired minimum coverage. When the cross-sectional dimensions vary, on the other hand, DAS-antennas are particularly suitable since they can offer extra coverage either by placement in the open spaces or by pointing directive beams towards the open spaces, with the antennas placed at positions that can be selected based on non-coverage-related aspects, such as ease of installation and cost. This is illustrated in FIG. 1*d* (required cabling to the antennas is not illustrated).

Indoor environments are often a mix of corridor-like spaces connecting open spaces. This is true e.g. for traditional office buildings, where "interaction areas" are sparsely distributed in the buildings. Similar combinations of narrow passages and open areas are common in underground public transportation facilities. The wireless traffic demand is related to the distribution of people in these areas, with open spaces often being associated with high demand (where large groups of people are stationary) and corridors being associated with lower demand (where people are moving, or stationary in smaller offices along the corridors). It would be desirable to provide, within the wireless system using MIMO, a capacity per unit area that matches the position-dependent traffic demand.

An object of the present disclosure is to solve or at least alleviate at least one of the above mentioned problems.

The object is according to a first aspect achieved by an antenna system for providing coverage for multiple-input multiple-output, MIMO, communication in mixed type of spaces. The antenna system comprises a leaky cable arranged to provide coverage in a first type of space, and a distributed antenna system comprising one or more antennas and arranged to provide coverage in a second type of space. Each of the one or more antennas of the distributed antenna system is connected to the leaky cable through a circulator and the MIMO communication is enabled by both ends of the leaky cable being adapted for connection to a respective antenna port of a network node configured for MIMO communication.

The antenna system provides an improved, more uniform coverage and improved capacity for MIMO communication in environments that comprise mixed type of spaces. That is, in spaces having different geometry, such as a first type of space comprising e.g. cylinder-like spaces, such as corridors and tunnels, and a second type of space comprising an open type of space, e.g. a large room. The communication capacity per unit area can be made to match the position-dependent traffic demand by using the leaky cable as communication means or the DAS as communication means or both, in dependence on the expected traffic demand in the different types of space.

The object is according to a second aspect achieved by a method for providing multiple-input, multiple-output, MIMO, communication using an antenna system as above. The method comprises: connecting an end of the leaky cable to a first antenna port of a network node configured for MIMO communication and connecting the opposite end of the leaky cable to a second antenna port of the network node.

The object is according to a third aspect achieved by a system comprising an antenna system as above, wherein one end of the leaky cable is connected to a first antenna port of the network node and the opposite end of the leaky cable is connected to a second antenna port of the network node.

Further features and advantages of the present disclosure will become clear upon reading the following description and the accompanying drawings.

DETAILED DESCRIPTION

Figure 1A:
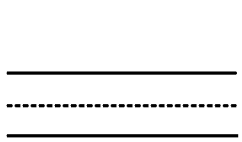
FIGS. 1*a*, 1*b*, 1*c*, 1*d* illustrate deployment of leaky cables and distributed antennas, respectively.
Figure 1B:
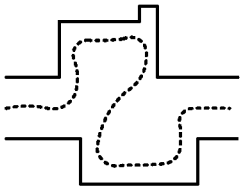
Figure 1C:
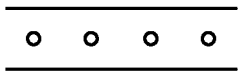
Figure 1D:
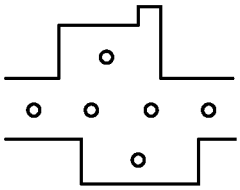

In the following description, for purposes of explanation and not limitation, specific details are set forth such as particular architectures, interfaces, techniques, etc. in order to provide a thorough understanding. In other instances, detailed descriptions of well-known devices, circuits, and methods are omitted so as not to obscure the description with unnecessary detail. Same reference numerals refer to same or similar elements throughout the description.

Briefly, the present disclosure provides a solution to problems related to providing good coverage and capacity for a MIMO wireless system in environments which comprise of a mix of cylinder-like areas (corridors, tunnels, etc.) and open spaces, in particular indoor environments. Aspects of leaky cables and distributed antenna system (DAS) are used for providing a heterogeneous deployment of both leaky cables and antennas of DAS. An antenna system comprising leaky cables and the DAS-antennas, may be daisy-chained using circulators, connected to the same single feeder line (which itself may be a leaky cable), for providing coverage and capacity over of a given area, with leaky cables covering cylinder-like areas and DAS-antennas covering open spaces. Further, the antenna system is fed from both ends of the single feeder line, thus providing MIMO capability.

Figure 2:
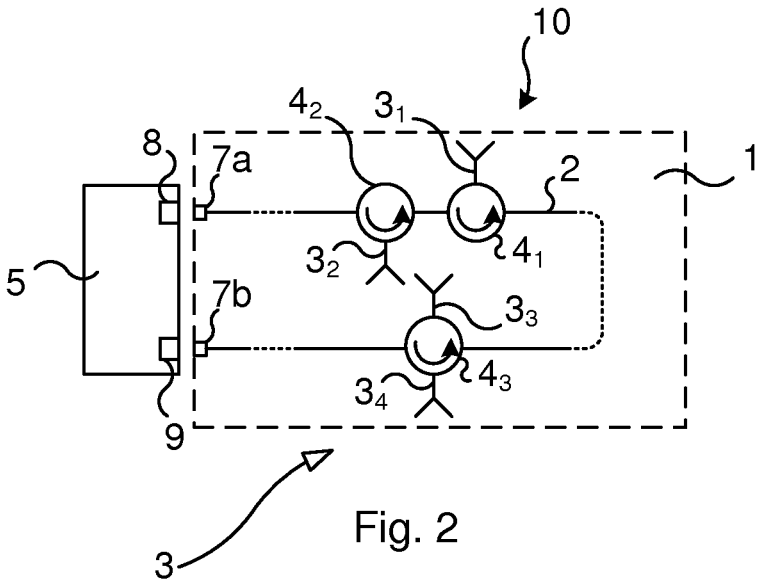
FIG. 2 illustrates an embodiment of a system and an antenna system in accordance with the present disclosure and in particular means for providing bi-directional antenna feeding.

FIG. 2 illustrates an embodiment of an antenna system in accordance with the present disclosure and in particular means for providing bi-directional antenna feeding. The antenna system 1 comprises a leaky cable 2 and a number of antennas $\mathbf{3}_1$, $\mathbf{3}_2$, $\mathbf{3}_3$, $\mathbf{3}_4$ connected to the leaky cable 2 by means of circulators $\mathbf{4}_1$, $\mathbf{4}_2$, $\mathbf{4}_3$.

The leaky cable 2 may comprise a coaxial cable, e.g. a shielded coaxial cable. The leaky cable 2 comprises slits or slots enabling communication signals transported along its length to emanate out to the surrounding environment. It is noted that the leaky cable 2 may be adapted for use in a particular environment in that it may have such slots only in parts where communication is required, and no such slots where communication is not needed, e.g. since such parts of the environment is covered by the antennas $\mathbf{3}_1$, $\mathbf{3}_2$, $\mathbf{3}_3$, $\mathbf{3}_4$.

A leaky cable has two ends, wherein one end conventionally is connected to a network node and used to feed/sense the cable whereas the other end is terminated or left open. In the present disclosure, both ends of the leaky cable 2 are connected to a network node 5, and in particular to a respective antenna port 8, 9 of the network node 5. The network node 5 may thus feed/sense the leaky cable 2 via antenna ports 8, 9 thereof at both ends of the leaky cable 2. A first end of the leaky cable 2 is connected to a first antenna port 8 and the second end of the leaky cable 2 is connected to a second antenna port 9.

The ends of the leaky cable 2 are connectable to the network node 5. The leaky cable 2 is thus at the ends thereof adapted to be connected to the network node 5 configured to provide wireless communication to one or more communication devices (not illustrated). In particular, the leaky cable 2 is connectable to the network node 5, for example by comprising a respective connection device 7*a*, 7*b* at its cable ends, the connection device 7*a*, 7*b* for example comprising antenna connectors.

The network node 5 may for example comprise a radio base station, e.g. an evolved node B (also denoted eNB and eNodeB). When feeding the leaky cable 2, signals are transmitted from the network node 5 through the leaky cable 2 and the signals may be received by communication devices (not illustrated) located within coverage area of the network node 5. The feeding of the leaky cable is thus a downlink direction, from the network node 5 to communication devices. When sensing the leaky cable 2, signals sent by communication devices are received by means of the leaky cable 2.

The sensing of the leaky cable is thus an uplink direction, from the communication device to the network node 5.

The antenna system 1 also comprises a number of antennas $\mathbf{3}_1$, $\mathbf{3}_2$, $\mathbf{3}_3$, $\mathbf{3}_4$, which antennas may be seen as a distributed antenna system 3 wherein each antenna can be seen as a point source. Reference numeral 3 in FIG. 2 is intended to generally encompass any such antenna $\mathbf{3}_1$, $\mathbf{3}_2$, $\mathbf{3}_3$, $\mathbf{3}_4$. The antennas may for example be dipole antennas, patch antennas etc. Each of the antennas $\mathbf{3}_1$, $\mathbf{3}_2$, $\mathbf{3}_3$, $\mathbf{3}_4$ is connected to the leaky cable 2 via a circulator $\mathbf{4}_1$, $\mathbf{4}_2$, $\mathbf{4}_3$. The circulators $\mathbf{4}_1$, $\mathbf{4}_2$, $\mathbf{4}_3$ may be three-port circulators (as illustrated by circulators $\mathbf{4}_1$, $\mathbf{4}_2$), or four-port circulators (as illustrated by circulator $\mathbf{4}_3$). The circulator $\mathbf{4}_1$, $\mathbf{4}_2$, $\mathbf{4}_3$ is a passive device, in which a radio frequency (RF) signal entering any port is transmitted to the next port in rotation. In the figure, the rotation direction is indicated in conventional manner by an arrow. It is noted that although only a few antennas and circulators are illustrated and described, the antenna system 1 may comprise any number of antennas and circulators and it is further noted that the circulators may be configured in different ways to the leaky cable 2, i.e. the ports of the circulators can be connected in different ways to the leaky cable 2 for providing a desired signal transfer.

The circulators $4_1$, $4_2$, $4_3$ provide simultaneous feeding of the antennas $3_1$, $3_2$, $3_3$, $3_4$ for energy impinging from both directions along the leaky cable 2. The directions referred to are thus uplink, i.e. signals received at the antennas (or leaky cable 2) for conveyance to the network node 5, and downlink, i.e. signals sent from the network node 5 to be received by the communication devices. A bi-directional feeding is thus provided. MIMO functionality is also provided, i.e. several of the antennas $3_1$, $3_2$, $3_3$, $3_4$ may e.g. receive signaling from a particular communication device, which signaling is conveyed to the network node 5. The network node 5 may then process the signals so as to provide improved signal quality. The MIMO functionality of spatial multiplexing is also supported by the antenna system 1, providing increased data throughput capacity.

Each circulator $4_1$, $4_2$, $4_3$ is adapted to pass a certain amount of energy to an antenna with which it is interconnected. In particular, RF energy sent along the length of the leaky cable 2 reaches one port of a circulator and is passed to the next port thereof. Each antenna $3_1$, $3_2$, $3_3$, $3_4$ is mismatched to the leaky cable 2 so that only a configured amount of the energy is radiated by the antenna. That is, taking the leftmost antenna of the FIG. 2, antenna $3_2$, as an example: if it were impedance matched to the transmission line (i.e. the leaky cable) it would radiate all energy that it receives from the network node 5 in downlink and the desired coverage would not be obtained. Therefore the antennas $3_1$, $3_2$, $3_3$, $3_4$ are mismatched, providing a desired fraction of the incident power to be transmitted/received by a respective antenna. The antennas may thus be connected to the feeder line (i.e. leaky cable 2) using e.g. mismatched components, e.g. power dividers used, as a means to control the amount of power radiated per antenna. Such mismatch may be accomplished by adapting the impedance of the antennas to be mismatched to the impedance of the leaky cable 2, thus providing a desired fraction of the energy to be transmitted/received by the respective antenna. The amount of power radiated at different locations may be controlled by selecting desired combinations of attenuation rate of the leaky cable 2, gain of the antennas $3_1$, $3_2$, $3_3$, $3_4$ or by using other components that are mismatched, for example selecting transmission line based on impedance, e.g. using a transmission line with different impedance than the antenna impedance.

The mismatch of the antennas $3_1$, $3_2$, $3_3$, $3_4$ may be adapted so as to provide similar coverage in uplink as in downlink. Assume, as a particular example for illustrating this that two antennas are provided connected to a respective three-port circulator. For both antennas to have same transmission power (downlink), the first antenna (refer e.g. to the left-most three-port antenna $3_2$ of FIG. 2) may have a transmit reflection factor so that half of the energy incident on is left-most port is passed to the next port (as indicated by arrow indicating rotation direction) and radiated by the antenna, and the remaining energy is then passed on to its next port and further to the second antenna, that have the same port configuration as this first antenna. The second antenna, if having perfect impedance matching then transmits the remaining energy and the same downlink transmission power is accomplished in both antennas. However, to have perfect impedance matching for the second antenna would mean that all energy received by the first antenna for uplink would be transmitted by the second antenna. Thus, in an embodiment, the mismatch is configured such that the impedance for the uplink is different from the impedance for the downlink. This is a suitable embodiment for Frequency Division Duplexing (FDD) systems, which use different carrier frequencies in uplink and downlink and require the antennas to be configured to have a reversed mismatch with respect to the amount of power transmitted/received. As a particular numerical example, provided purely to enhance understanding and not to be construed as limiting for the scope of present disclosure, the following can be noted. For three serially-fed antennas with lossless coaxial cable connection with transmit reflection factor S11_tx={−1.8, −3, −infinity} dB respectively, all antennas will transmit the same power. To have all antennas receive the same power (assuming same incident power density), the antennas should have a receive reflection factor of S11_rx={−infinity, −3, −1.81} dB respectively.

The antennas $3_1$, $3_2$, $3_3$, $3_4$ may be arranged to provide overlapping coverage by providing antennas having different orthogonal polarization. The antennas may thus be dual-polarized, i.e. be able to operate in vertical as well as horizontal polarization.

Figure 3:
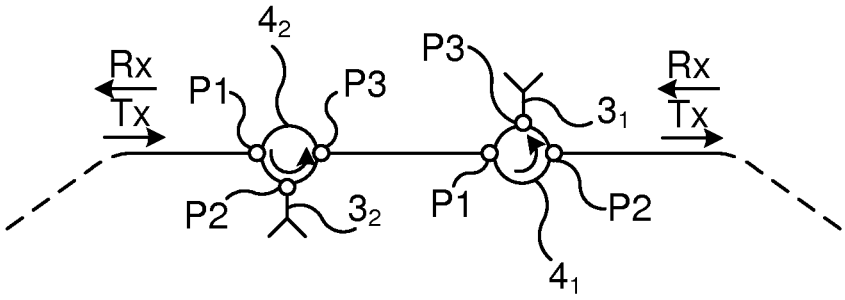
FIG. 3 illustrates an embodiment of an antenna system in accordance with the present disclosure.

The bi-directional antenna feeding may be provided by arranging two or more three-port circulators $4_1$, $4_2$ or by arranging one or more four-port circulator $4_3$. Referring to FIG. 3, two three-port circulators $4_1$, $4_2$ are illustrated, wherein the leftmost three-port circulator $4_2$ is connected at its first port P1 to the transmission line, i.e. the leaky cable 2, at its second port P2 to an antenna $3_2$ and at its third port P3 to the leaky cable 2 again. The rightmost three-port circulator $4_1$ is connected at its first port P1 to the leaky cable 2, at its second port P2 to the leaky cable 2 and at its third port P3 to an antenna $3_1$. The two three-port circulators $4_1$, $4_2$ provide bi-directional communication. For downlink (indicated by arrow Tx) signals sent from the first antenna port 8 of the network node 5 (refer to FIG. 2), the leftmost three-port circulator $4_2$ receives the signal at its first port P1, passes it to the antenna $3_2$ which transmits a configured part of the received signal energy and passes the rest of the energy to its third port P3. The rightmost three-port circulator $4_1$ receives this energy at its first port P1, passes it to the second port P2 and further along the leaky cable 2, which transmits the energy along its length. The circulators may also receive downlink signals from the other antenna port 9, and then transmits the signal in corresponding way. In uplink (indicated by arrow Rx) the rightmost three-port circulator $4_1$ receives a signal at the antenna $3_1$ which passes the received signal energy to its first port P1. The leftmost three-port circulator $4_2$ receives this energy at its third port P3, passes it to the first port P1 and further along the leaky cable 2 to the network node 5. Although part of the signal energy received by the antenna $3_1$ is or may be radiated by the leaky cable 2 (depending on arrangement of slots of the leaky cable), the signals received at the network node 5 may be processed in satisfactory manner. Further, as noted earlier, the leaky cable 2 may be arranged to be "leaky" at some parts along its length and arranged to not be "leaky" at other parts of its length by providing the earlier mentioned slots only at suitable parts thereof. In an area having a tunnel-like shape, the leaky cable 2 should be arranged to provide communication, i.e. to be "leaky", while in areas having a more open space, the communication can be relied on to be provided by the antennas $3_1$, $3_2$, $3_3$, $3_4$ of the distributed antenna system and the leaky cable 2 is in such areas not "leaky", i.e. is not provided with slots.

Referring briefly to FIG. 2 again, the bi-directional antenna feeding may be provided by arranging one four-port circulator $4_3$. As illustrated in the figure, the four-port circulator $4_3$ is at its leftmost port connected to the leaky cable 2, at its upper port connected to a first antenna $3_3$, at its lower antenna port to a second antenna $3_4$ and at its rightmost port to the leaky cable 2. In downlink, energy is received at its leftmost port, and passed to the antenna $3_4$, which radiates a configured amount thereof, passing the rest to the rightmost port of the circulator $4_3$ and further along the leaky cable 2. In uplink, when the first antenna $3_3$ receives signals from communication devices it passes it to the leftmost port of the circulator $4_3$, then further along the leaky cable 2 to be received by the network node 5 in its second antenna port 9. When the second antenna $3_4$ receives signals from communication devices it passes it to the rightmost port of the circulator $4_3$, then further along the leaky cable 2 to be received by the network node 5 in its first antenna port 8. As mentioned earlier, part of the signal energy is radiated through the leaky cable 2 and, depending on the configuration of the circulators, also through some of the antennas along the way to the network node 5.

The antenna system 1 is thus configured to provide coverage by means of the leaky cable 2 in combination with the distributed antenna system (DAS), which comprises the one or more antennas $3_1$, $3_2$, $3_3$, $3_4$. The antenna system 1 provides improved capacity and coverage in heterogeneous propagation environments for MIMO operation by using the different transmit/receive means. A configured amount of power radiated and received as function of position in space is provided. By using the leaky cable 2 where the environment is uniform and the DAS-antennas where the environment is open (although indoors) an improved solution is achieved wherein the amount of power radiated at different locations can be controlled by selecting desired combinations of leaky cable attenuation rate, antenna gain, and power dividers.

Figure 4A:
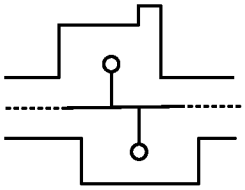
FIGS. 4*a*, 4*b*, 4*c*, 4*d* illustrate schematically different installation scenarios for an antenna system in accordance with the present disclosure.

FIGS. 4*a*, 4*b*, 4*c*, 4*d* illustrate schematically different installation scenarios for an antenna system 1 in accordance with the present disclosure. FIG. 4*a* illustrates a scenario wherein the leaky cable 2 covers corridor areas, as indicated by the dashed line. In open areas, the leaky cable 2 is not leaky (as indicated by the solid line), i.e. in this area it is non-radiating coaxial cable-feed. In this open type of areas, omni-directional antennas (indicated by the circles connected to the leaky cable 2) are used for coverage.

Figure 4B:
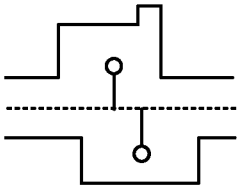

FIG. 4*b* illustrates a similar scenario, but wherein the leaky cable 2 is used also for signal routing through the open areas. Either of these two embodiments (FIG. 4*a*, 4*b*) may be advantageous, depending on cable and installation costs, size and shape of the open area, etc.

Figure 4C:
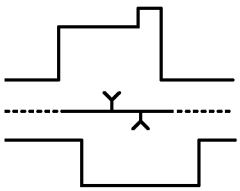
Figure 4D:
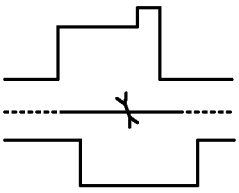

FIG. 4*c* illustrates that the leaky cable 2 is again used for coverage in corridors (dashed line), while single beam directional antennas are used in the open areas. FIG. 4*d* illustrates that the leaky cable 2 is again used for coverage in corridors (dashed line), while multi-beam directional antennas are used in the open areas. In both scenarios, the leaky cable 2 is arranged to be a conventional coaxial cable in the open spaces (i.e. not leaking).

Referring again to FIG. 2, the present disclosure provides, in an aspect, also a system 10 comprising an antenna system 1 in accordance with any of the embodiments that has been described and the network node 5. One end of the leaky cable 2 is connected to a first antenna port 8 of a network node 5 and the opposite end of the leaky cable 2 is connected to a second antenna port 9 of the network node 5, the network node 5 forming part of the system 10.

The present disclosure thus discloses, in an aspect, an antenna system 1 for providing uniform coverage for multiple-input multiple-output, MIMO, communication in mixed type of spaces. The antenna system 1 comprises:

a leaky cable 2 arranged to provide coverage in a first type of space, and a distributed antenna system 3 comprising one or more antennas $3_1$, $3_2$, $3_3$, $3_4$ and arranged to provide coverage in a second type of space, wherein each of the one or more antennas $3_1$, $3_2$, $3_3$, $3_4$ of the distributed antenna system 3 is connected to the leaky cable 2 through a circulator $4_1$, $4_2$, $4_3$, and wherein the MIMO communication is enabled by both ends of the leaky cable 2 being adapted for connection to a respective antenna port 8, 9 of a network node 5 configured for MIMO communication.

The communication capacity per unit area can be made to match the position-dependent traffic demand by using the leaky cable as communication means or the DAS as communication means or both, in dependence on the expected traffic demand. Depending on the layout of the space or area to be provided with wireless communication coverage, and thus the expected traffic demand, the leaky cable 2 and/or the distributed antenna system 2 of the antenna system 1 is installed in the corresponding space or area. The antenna system 1 is thus arranged to provide uniform coverage for MIMO communication in mixed types of spaces e.g. by adapting receiving/transmitting means to match an expected traffic demand in the particular type of space.

In an embodiment, each antenna $3_1$, $3_2$, $3_3$, $3_4$ of the distributed antenna system 3 is adapted to transmit a configured amount of energy received from the leaky cable 2 through a circulator $4_1$, $4_2$, $4_3$ to which it is connected and adapted to receive energy and pass on, to the leaky cable 2 a configured amount of the energy through a circulator $4_1$, $4_2$, $4_3$ to which it is connected.

In an embodiment, each antenna $3_1$, $3_2$, $3_3$, $3_4$ of the distributed antenna system 3 is adapted to transmit and receive the configured amount of energy by having a ratio of impedance to the impedance of the leaky cable 2 providing the respective configured amount of energy.

In a variation of the above embodiment, each antenna $3_1$, $3_2$, $3_3$, $3_4$ of the distributed antenna system 3 is adapted to transmit a configured first amount of energy by having a ratio of impedance to the impedance of the leaky cable at a first frequency, and wherein each antenna $3_1$, $3_2$, $3_3$, $3_4$ of the distributed antenna system 3 is adapted to receive a configured second amount of energy by having a ratio of impedance to the impedance of the leaky cable at a second frequency.

In an embodiment, each antenna $3_1$, $3_2$, $3_3$, $3_4$ of the distributed antenna system 3 is mismatched to the leaky cable 2.

In an embodiment, each antenna $3_1$, $3_2$, $3_3$, $3_4$ of the distributed antenna system 3 comprises an impedance mismatched to the impedance of the leaky cable 2.

In an embodiment, at least one antenna $3_1$, $3_2$, $3_3$, $3_4$ of the distributed antenna system 3 is a dual polarized antenna. Overlapping coverage may be provided by such antennas, which are able to operate in vertical as well as horizontal polarization.

In an embodiment, the amount of radiated power at different locations of the antenna system 1 is configured based on any combination of leaky cable attenuation, rate, antenna gain, number and placement of slots in the leaky cable 2, and/or provided power dividers.

In an embodiment, each of the both ends of the leaky cable 2 comprises a respective connector 6, 7, whereby the leaky cable 2 is adapted for connection to a respective antenna port 8, 9.

In an embodiment, the first type of space comprises an elongated space wherein one dimension is significantly larger than the other two, cross-sectional dimensions, such as cylinder-like spaces (e.g. tunnels or corridors of a building), and wherein the second type of space comprises an open space (e.g. platforms of a train station or meeting points such as conference rooms of a building).

In an embodiment, the ratio between length and width or height of the first space is significantly larger than the ratio between length and width or height of the second space. The present disclosure is thus applicable to environments having a mix of different types of spaces (areas). Such different types of spaces may be defined or described in different ways, and the above two embodiments are intended as examples thereof.

In an embodiment, each circulator $4_1$, $4_2$, $4_3$ is connected to the leaky cable 2 and arranged to pass a configured amount of energy to an antenna connected to it.

Figure 5:
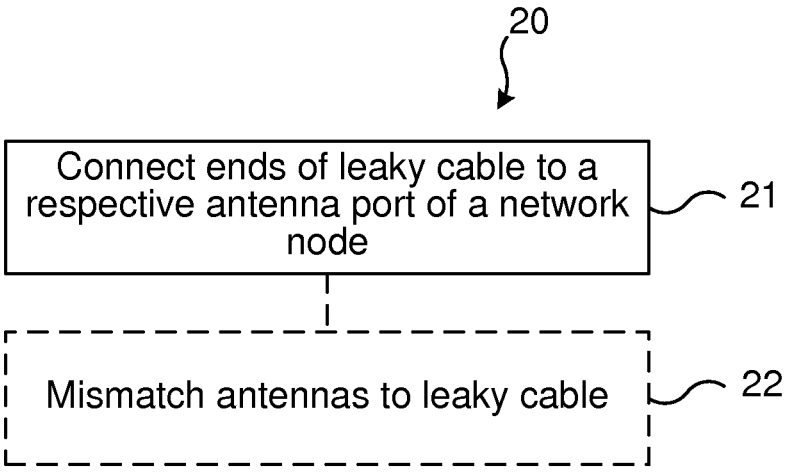
FIG. 5 a flow chart over steps of a method in accordance with the present disclosure.

Reference is now made to FIG. 5, which is a flow chart over steps of a method in accordance with the present disclosure. In particular the present disclosure provides, in an aspect, a method 20 for providing multiple-input, multiple-output, MIMO, communication using an antenna system 1 as described earlier. In a particular embodiment, the antenna system 1 comprises a leaky cable 2 arranged to provide coverage in a first type of space, and a distributed antenna system 3 comprising one or more antennas $3_1$, $3_2$, $3_3$, $3_4$ and arranged to provide coverage in a second type of space, wherein each of the one or more antennas $3_1$, $3_2$, $3_3$, $3_4$ of the distributed antenna system 3 is connected to the leaky cable 2 through a circulator $4_1$, $4_2$, $4_3$, and wherein the MIMO communication is enabled by both ends of the leaky cable 2 being adapted for connection to a respective antenna port 8, 9 of a network node 5 configured for MIMO communication. It is however noted that the method 20 may be used in and for any of the described embodiments of the antenna system 1.

The method 20 comprises connecting 21 an end of the leaky cable 2 to a first antenna port 8 of a network node 5 configured for MIMO communication and connecting the opposite end of the leaky cable 2 to a second antenna port 9 of the network node 5.

In an embodiment, the method 20 comprises mismatching 22 each antenna $3_1$, $3_2$, $3_3$, $3_4$ of the distributed antenna system 3 to the leaky cable 2 by selecting an impedance for each antenna $3_1$, $3_2$, $3_3$, $3_4$ that is mismatched to the impedance of the leaky cable 2. The mismatching may be adapted in dependence e.g. on the environment in which the antenna system 1 is to be installed.

In an embodiment, the method 20 comprises selecting an amount of power to be radiated at different location of the antenna system (1) by selecting any combination of leaky cable attenuation, rate, antenna gain, number and placement of slots in the leaky cable 2, and/or provided power dividers.

In an embodiment, the method 20 comprises feeding the leaky cable 2 from both ends thereof.

The present disclosure provides, in yet an aspect, a system 10 comprising an antenna system 1 as has been described, wherein one end of the leaky cable 2 is connected to a first antenna port 8 of a network node 5 and the opposite end of the leaky cable 2 is connected to a second antenna port 9 of the network node 5, the network node 5 forming part of the system 10.

The system 10 thus comprises an antenna system 1 and a network node 5. In a particular embodiment, the antenna system 1 comprises a leaky cable 2 arranged to provide coverage in a first type of space, and a distributed antenna system 3 comprising one or more antennas $3_1$, $3_2$, $3_3$, $3_4$ and arranged to provide coverage in a second type of space, wherein each of the one or more antennas $3_1$, $3_2$, $3_3$, $3_4$ of the distributed antenna system 3 is connected to the leaky cable 2 through a circulator $4_1$, $4_2$, $4_3$, and wherein the MIMO communication is enabled by both ends of the leaky cable 2 being adapted for connection to a respective antenna port 8, 9 of a network node 5 configured for MIMO communication. It is however noted that the system 10 may comprises any of the described embodiments of the antenna system 1.

As mentioned earlier, the network node 5 of the system 10 may for example be an enhanced node B, also denoted eNB and eNodeB, which is configured to communicate with communication devices.

The invention claimed is:

1. A distributed antenna system for providing coverage for multiple-input multiple-output (MIMO) communication in mixed type of spaces, the distributed antenna system comprising:

a leaky cable arranged to provide coverage in a first type of space, said leaky cable having i) a first end adapted for connection to a first antenna port of a network node configured for MIMO communication and ii) having a second end adapted for connection to a second antenna port of the network node;

a first antenna connected to the leaky cable through a first circulator, said first antenna arranged to provide coverage in a second type of space; and a second antenna connected to the leaky cable through the first circulator or through a second circulator, said second antenna arranged to provide coverage in the second type of space.

2. The distributed antenna system of claim 1, wherein the first antenna is adapted to transmit a configured amount of energy received from the leaky cable through the circulator to which the first antenna is connected and is further adapted to receive energy and to provide to the leaky cable a configured amount of the received energy, and the second antenna is adapted to transmit a configured amount of energy received from the leaky cable through the circulator to which the second antenna is connected and the second antenna is further adapted to receive energy and to provide to the leaky cable a configured amount of the received energy.

3. The distributed antenna system of claim 2, wherein the first and second antennas are adapted to transmit and receive the configured amount of energy by having a ratio of impedance to the impedance of the leaky cable providing the respective configured amount of energy.

4. The distributed antenna system of claim 3, wherein the first antenna is adapted to transmit a configured first amount of energy by having a ratio of impedance to the impedance of the leaky cable at a first frequency, and wherein the first antenna is adapted to receive a configured second amount of energy by having a ratio of impedance to the impedance of the leaky cable at a second frequency.

5. The distributed antenna system of claim 1, wherein each of the first and second antennas is mismatched to the leaky cable.

6. The distributed antenna system of claim 1, wherein each of the first and second antenna comprises an impedance mismatched to the impedance of the leaky cable.

7. The distributed antenna system of claim 1, wherein the first antenna is a dual polarized antenna.

8. The distributed antenna system of claim 1, wherein the amount of radiated power at different locations of the antenna system is configured based on any combination of leaky cable attenuation, rate, antenna gain, number and placement of slots in the leaky cable, and/or provided power dividers.

9. The distributed antenna system of claim 1, wherein each of the both ends of the leaky cable comprises a respective connector, whereby the leaky cable is adapted for connection to a respective antenna port.

10. The distributed antenna system of claim 1, wherein the first type of space comprises an elongated space, and wherein the second type of space comprises an open space.

11. The distributed antenna system of claim 1, wherein the ratio between length and width or height of the first space is larger than the ratio between length and width or height of the second space.

12. The distributed antenna system of claim 1, wherein the first circulator is connected to the leaky cable and is arranged to pass a configured amount of energy to the first antenna.

13. A system comprising the distributed antenna system as claimed in claim 1, wherein the first end of the leaky cable is connected to the first antenna port of the network node and the second end of the leaky cable is connected to the second antenna port of the network node.

14. The distributed antenna system of claim 1, wherein the second antenna is connected to the leaky cable through the first circulator, the first circulator comprises a first port, a second port, a third port and fourth port, the first antenna is directly connected to the first port of the first circulator, and the second antenna is directly connected to the second port of the first circulator.

15. A method for providing multiple-input, multiple-output (MIMO) communication, the method comprising:

obtaining distributed antenna system comprising: A) a leaky cable arranged to provide coverage in a first type of space, said leaky cable having a first end and a second end, B) a first antenna connected to the leaky cable through a first circulator, said first antenna arranged to provide coverage in a second type of space, and C) a second antenna connected to the leaky cable through the first circulator or through a second circulator, said second antenna arranged to provide coverage in the second type of space;

connecting the first end of the leaky cable to a first antenna port of a network node configured for MIMO communication;

connecting the second end of the leaky cable to a second antenna port of the network node.

16. The method of claim 15, comprising mismatching each of the first and second antenna to the leaky cable by selecting an impedance for each of the first and second antenna that is mismatched to the impedance of the leaky cable.

17. The method of claim 15, comprising selecting an amount of power to be radiated at different location of the antenna system by selecting any combination of leaky cable attenuation, rate, antenna gain, number and placement of slots in the leaky cable, and/or provided power dividers.

18. The method of claim 15, comprising feeding the leaky cable from both ends thereof.

19. The method of claim 15, further comprising:

positioning the leaky cable in a corridor;

using the leaky cable to radiate a signal in the corridor;

positioning the first antenna in a room connected to the corridor, the room comprising an open space; and using the first antenna to radiate the signal in the room.

20. The method of claim 15, wherein the second antenna is connected to the leaky cable through the first circulator, the first circulator comprises a first port, a second port, a third port and fourth port, the first antenna is directly connected to the first port of the first circulator, and the second antenna is directly connected to the second port of the first circulator.

* * * * *